United States Patent [19]

Schweitzer

[11] 4,242,545

[45] Dec. 30, 1980

[54] MECHANICAL SWITCH

[75] Inventor: Hans E. Schweitzer, Wettingen, Switzerland

[73] Assignee: H. E. Schweitzer AG, Wettingen, Switzerland

[21] Appl. No.: 868,689

[22] Filed: Jan. 11, 1978

[30] Foreign Application Priority Data

Jan. 12, 1977 [CH] Switzerland ..... 326/77

[51] Int. Cl.[3] ..... H01H 9/20; H01H 13/50

[52] U.S. Cl. ..... 200/5 R; 200/153 J; 200/296; 200/314; 200/328

[58] Field of Search ..... 200/5 E, 5 EA, 5 EB, 200/17 R, 18, 153 T, 293, 294, 295, 296, 302, 303, 307, 330; 248/27.1, 27.3

[56] References Cited

U.S. PATENT DOCUMENTS

| | | | |
|---|---|---|---|
| 2,104,206 | 1/1938 | Meuer | 200/296 X |
| 2,740,023 | 3/1956 | Kryder | 200/302 X |
| 2,916,673 | 12/1959 | Maslin et al. | 200/314 X |
| 2,956,446 | 10/1960 | Ensign, Jr. et al. | 200/314 X |
| 2,984,726 | 5/1961 | Roeser | 200/302 |
| 3,267,245 | 8/1966 | Vincent | 200/314 |
| 3,300,613 | 1/1967 | Cox, Jr. | 200/5 EA |
| 3,371,180 | 2/1968 | Frank | 200/296 |
| 3,663,780 | 5/1972 | Golbeck | 200/294 X |
| 3,676,630 | 7/1972 | Dennison | 200/307 X |
| 3,731,028 | 1/1973 | Ando | 200/314 |
| 3,866,008 | 2/1975 | Teruzzi | 200/303 |

FOREIGN PATENT DOCUMENTS 2233877 1/1974 Fed. Rep. of Germany ..... 200/307

*Primary Examiner*—James R. Scott
*Attorney, Agent, or Firm*—Peter K. Kontler

[57] ABSTRACT

A momentary or latching mechanical switch wherein the externally threaded outer end portion of the housing has axially parallel external grooves each including a deeper portion, and the frame for the illuminated knob for a reciprocable plunger in the housing has elastic arms extending into the grooves and provided with protuberances received in the deeper portions of the respective grooves. The arms are separably held in their grooves by a nut which meshes with the end portion and is rotatable in a direction to expose the arms. The housing is inserted into the opening of a control panel from within before the arms of the frame are inserted into their grooves from the outside of the control panel, and the nut is thereupon rotated against the inner side of the control panel to confine the arms in their grooves and to urge the frame against the outer side of the control panel. The inner end portion of the housing is separably coupled to an adapter which separably supports several microswitches. A pin which is held in a slit-shaped opening of the housing and extends into a heart-shaped guide groove of the plunger is used when the switch is to function as a latching switch. When the pin is removed, the switch constitutes a momentary switch.

21 Claims, 15 Drawing Figures

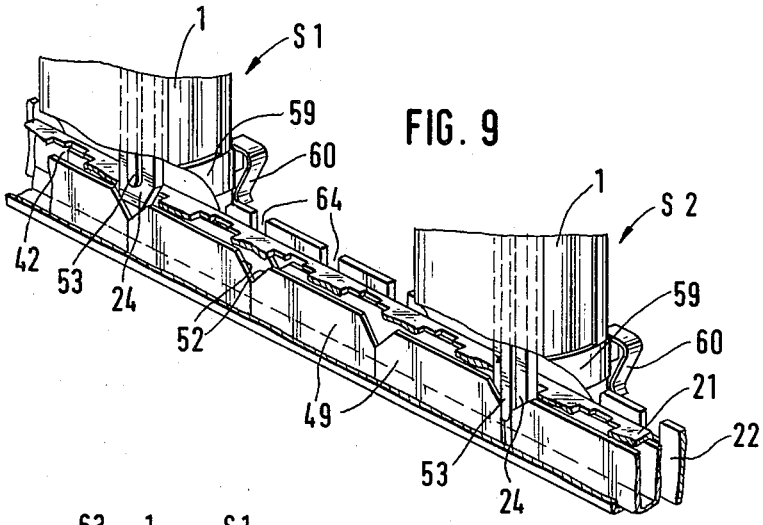
FIG. 9
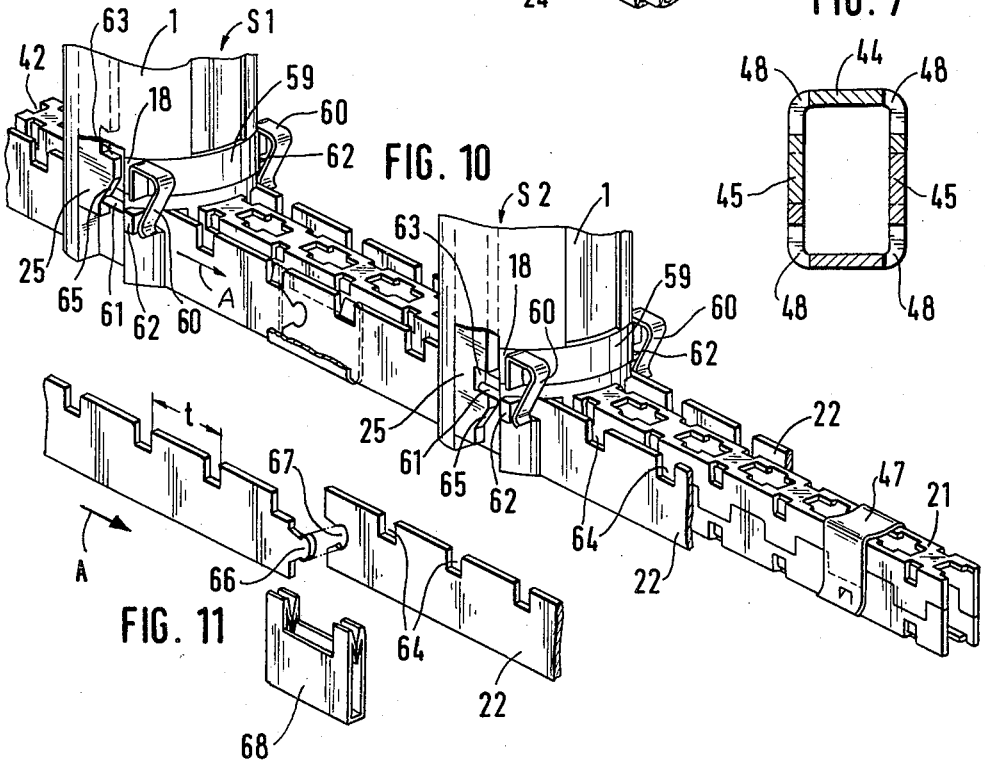
FIG. 10
FIG. 11
FIG. 7

MECHANICAL SWITCH

BACKGROUND OF THE INVENTION

The present invention relates to mechanical switches in general, and more particularly to improvements in mechanical switches of the type known as latching and momentary switches. As used in this description, the term "latching switch" denotes a mechanical switch wherein each second displacement of a knob, pushbutton, lever or rotary actuating element is followed by movement of a circuit-completing manner (e.g., a reciprocable plunger) to free position. The term "momentary switch" denotes mechanical switches wherein each and every displacement of a knob or the like is followed by movement of the circuit-completing member to free position.

Certain presently known mechanical latching or momentary switches comprise a housing which is rigidly connected to or made integral with a frame for the actuating element. The actual switching element or elements (e.g., one or more microswitches) are mounted at that end of the housing which is remote from the frame. Each movement of the circuit-completing member from its free position to its operating position results in actuation of each and every switching element. That portion of the housing which is adjacent to the frame is formed with external threads adapted to mate with the internal threads of a nut. When a switch of the just outlined character is to be installed in a control panel or the like, the nut is detached from the housing and the housing is introduced into and through a suitably configurated opening into the interior of the structure including the control panel. The insertion is terminated when the frame abuts against the outer side of the control panel. The nut is thereupon placed into mesh with the housing at the inner side of the control panel so that it clampingly engages the control panel opposite the frame. This insures that the switch is incapable of performing any stray movements with respect to the control panel.

A drawback of the just described conventional switch is that its component parts must be taken apart prior to mounting of the switch in or on a control panel or the like. Moreover, each switch must be installed individually; this is especially cumbersome when a control panel is to support a large number of switches, e.g., a long row or another array of latching and/or momentary switches.

It is further known to provide the externally threaded housing of a latching or momentary switch with an internally threaded neck portion which extends forwardly or outwardly beyond the external threads. When the switch is to be installed in a control panel or the like, the neck portion of the housing is caused to pass from the inside through a suitable bore or hole of the control panel. In the next step, the person in charge places the frame against the outer side of the neck portion so that the frame abuts against the outer side of the control panel. The frame is held in such position by a ring having external threads mating with the threads of the neck portion. In the next-following step, the aforementioned nut is applied to bear against the inner side of the control panel and to maintain the frame in clamping engagement with the outer side of the control panel. The just described conventional switches are not suited for use in combination with one or more additional switches; moveover, their manufacturing cost is high and the mounting of such switches in a control panel or the like is a tedious and time-consuming operation.

OBJECTS AND SUMMARY OF THE INVENTION

An object of the invention is to provide a mechanical switch, particularly a momentary switch or a latching switch, with novel and improved means for facilitating the mounting of the switch in a control panel or the like.

Another object of the invention is to provide a mechanical switch which can include one or more microswitches or analogous switching elements and wherein the contacts of each switching element are readily accessible together with the contacts which connect a light source in the housing of the switch with a source of electrical energy.

A further object of the invention is to provide a mechanical switch which can be rapidly and conveniently converted from a momentary switch into a latching switch or vice versa.

Another object of the invention is to provide the switch with novel and improved means for securing the frame for the actuating element (such as a pushbutton or a lever) to the housing of the switch.

An ancillary object of the invention is to provide the switch with novel and improved means for separably coupling the switch housing with one or more microswitches or analogous switching elements.

A further object of the invention is to provide a mechanical switch of the above outlined character with novel and improved means for supporting a block of microswitches or the like and to construct and assemble the microswitches in such a way that they provide room for reception of contacts which connect a lamp or a like device for illuminating the lever or knob to a source of electrical energy.

One feature of the invention resides in the provision of a mechanical switch, particularly a latching or momentary switch, which comprises an elongated housing including a tubular end portion having external threads and a plurality of external grooves extending lengthwise of the housing, a frame adjacent to the end portion and having preferably elastic arms extending into the grooves of the end portion, and a nut which meshes with the end portion of the housing and surrounds the arms. The frame serves for reception of a knob, lever or an analogous actuating element and is separable from the housing upon rotation of the nut in a direction to expose the arms. In accordance with a presently preferred embodiment, the end portion of the housing has four grooves spaced apart from each other by 90 degrees, as considered in the circumferential direction of the end portion. At least one of the grooves preferably includes a shallower first portion of lesser depth and a second portion of greater depth. The corresponding arm of the frame has a protuberance which is received in the deeper portion of the respective groove so that such arm cannot be extracted from its groove while the nut is held in that axial position in which it surrounds the arms. The clearance with which the one arm is received in the respective groove is less than the clearance which is necessary to withdraw the arm having a protuberance from its groove while the arms are surrounded by the nut.

The novel features which are considered as characteristic of the invention are set forth in particular in the appended claims. The improved switches and groups of switches themselves, however, both as to their construction and mode of operation, together with additional features and advantages thereof, will be best understood upon perusal of the following detailed description of certain specific embodiments with reference to the accompanying drawing.

BRIEF DESCRIPTION OF THE DRAWING

FIG. 7 is a transverse sectional view as seen in the direction of arrows from the line VII—VII of FIG. 6;

FIG. 9 is a perspective view of a multiple-switch arrangement including a battery of several switches and the associated receptacle or support, with portions of the switches and receptacle broken away;

FIG. 10 illustrates the structure of FIG. 9 and a second rail of a pair of control rails which serve to permit return movement of the plunger of one switch to free position in response to depression of the plunger of another switch;

FIG. 11 is an exploded perspective view of one of the control rails shown in FIGS. 9 and 10;

DESCRIPTION OF THE PREFERRED EMBODIMENTS

Figure 1:
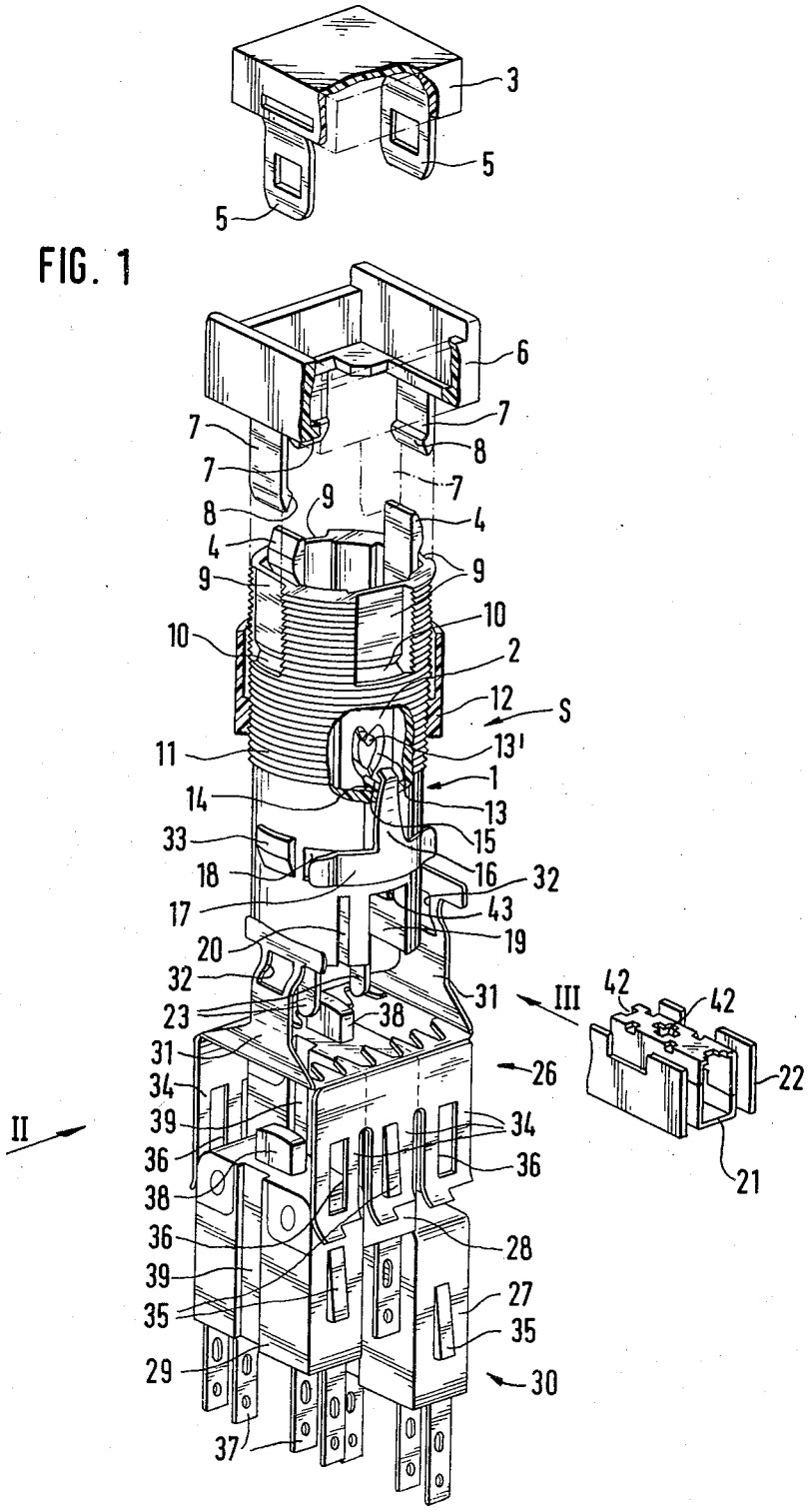
FIG. 1 is an exploded perspective view of a mechanical switch which can be converted from a momentary into a latching switch or vice versa and embodies one form of the invention; portions of certain constituents of the switch being broken away.
Figure 2:
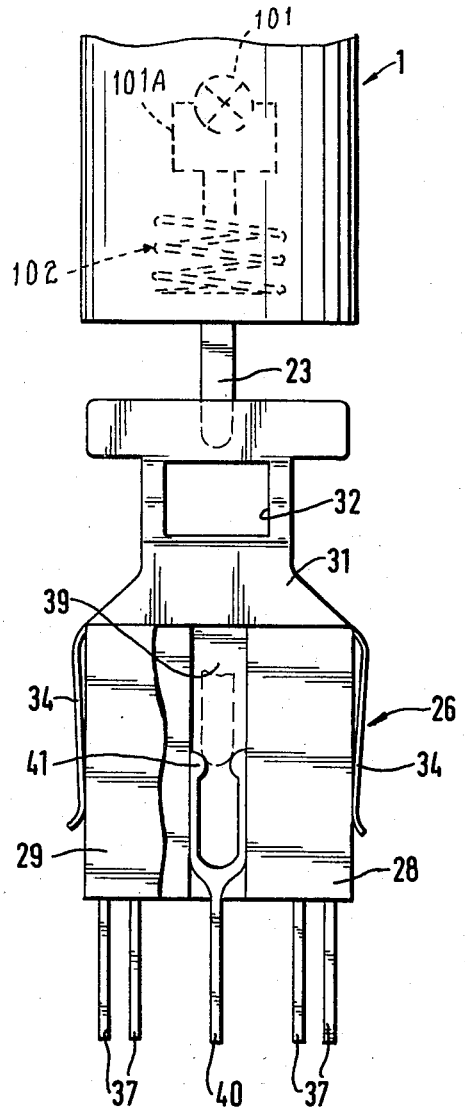
FIG. 2 is an enlarged partly side elevational and partly sectional view of a detail as seen in the direction of arrow II in FIG. 1.
Figure 3:
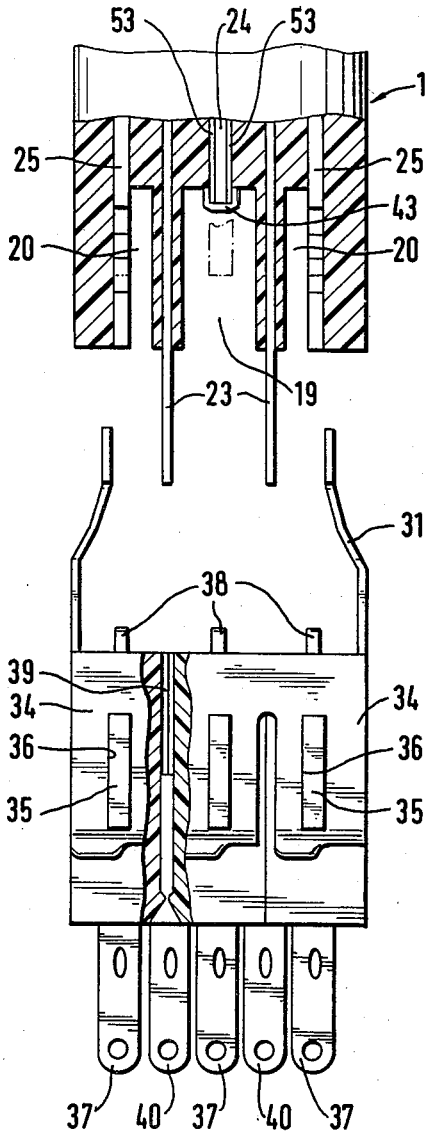
FIG. 3 is an enlarged partly side elevational and partly sectional view of another detail as seen in the direction of arrow III in FIG. 1.

Referring first to FIGS. 1 to 3, there is shown a mechanical pushbutton switch S which comprises an elongated tubular housing 1 for a reciprocable member here shown as a switch plunger 2. A suitable spring 102 (schematically shown in FIG. 2) permanently urges the plunger 2 to the non-depressed or extended position (the so-called free position). When the plunger 2 is depressed, either by hand or by a trip or the like, it assumes the operating position. The means for transmitting motion to the plunger 2 in a direction to move the latter from the free position to the operating position comprises a separable actuating element here shown as a pushbutton or knob 3 having two downwardly extending apertured elastic arms 5 for reception of projections provided on elastically deformable arms 4 at the upper end of the plunger 2 (as viewed in FIG. 1). The arms 4 and 5 together constitute a simple coupling which insures that the plunger 2 shares all movements of the knob 3 and vice versa as soon as the projections of the arms 4 enter the apertures of the respective arms 5. The spring 102 (e.g., a helical spring which reacts against the housing 1 or against a part which is attached to the housing and bears against the inner end of the plunger 2) automatically returns the plunger to the free position as soon as the pressure upon the exposed upper side of the knob 3 is terminated or relaxed.

The knob 3 is reciprocable in a rectangular frame 6 which is separably coupled to the adjacent end portion of the housing 1. To this end, the frame 6 comprises four downwardly extending elastic tongues or arms 7 having inwardly extending protuberances or beads 8 which can be received in recesses or sockets 10 provided in the external surface of the upper end portion of the housing 1. The sockets 10 constitute the deepmost portions of grooves 9 which are machined into or otherwise formed in the external surface of the housing 1 and are parallel to the axis of the plunger 2. The depth of the grooves 9 and of their sockets 10 is preferably selected in such a way that the tongues 7 and their protuberances 8 are fully receivable therein, i.e., that the outer sides of the tongues 7 do not extend outwardly beyond the peripheral surface of the upper end portion of the housing 1. The angular spacing between neighboring grooves 9 of the housing 1 is preferably 90 degrees, i.e., the grooves 9 are preferably equally spaced from each other, as considered in the circumferential direction of the housing 1.

The upper end portion of the housing 1 (i.e., that end portion which is nearest to the knob 3) is formed with external threads 11 which mate with the internal threads of a cylindrical sleeve-like nut 12. When the frame 6 is properly coupled to the housing 1 so that the tongues 7 are fully received in the respective grooves 9, the nut 12 is rotated in a direction to advance toward the inner end face of the frame 6 and to thus clampingly engage a plate or wall (not specifically shown) of a control panel or the like in which the switch S is installed. The nut 12 then abuts against the inner side and the frame 6 engages the outer side of such plate or wall. At the same time, the nut 12 confines the tongues 7 and prevents forcible extraction of such tongues from the respective grooves 9 because the clearances with which the tongues 7 are received in their grooves 9 is less than that which is necessary to extract the protuberances or beads 8 from the corresponding sockets 10 when the outer sides of the tongues 7 are within the confines of the nut 12. When the switch S is to be installed in a control panel or the like, the housing 1 is inserted from the inside so that its upper end portion (as viewed in FIG. 1) extends through and beyond a suitably configurated opening in the plate or wall of the control panel. Such insertion of the housing 1 is preceded by rotation of the nut 12 to the illustrated position in which the nut 12 exposes the grooves 9 and their sockets 10. In the next step, the person in charge couples the frame 6 to the housing 1 by pushing the tongues 7 into the corresponding grooves 9 until the protuberances 8 (of the elastic tongues 7) snap into the corresponding sockets 10. The nut 12 is thereupon rotated to move toward the frame 6 and to engage the inner side of the plate or wall of the control panel while urging the outer side of such plate or wall against the frame 6. The knob 3 can be coupled to the plunger 2 prior or subsequent to coupling of frame 6 to the housing 1.

The just described mode of assembling the parts 1, 6 and 2, 3 while simultaneously securing the housing 1 to the wall of a control panel or the like is especially advantageous when the wall of the control panel is to support a plurality of switches S. Furthermore, each switch S may comprise a block or group 30 of several (e.g., three) discrete switching elements such as microswitches 27, 28 and 29 shown in the lower portion of FIG. 1. The arrangement is preferably such that the microswitches 27–29 of several discrete switches S need not be taken apart and/or detached from the respective housings 1 prior to mounting of switches S on the wall of the control panel. Thus, the microswitches 27–29 can be grouped together (to form a block 30) at the manufacturing or assembling plant and need not be separated from the respective housings 1 prior to mounting of switches S in the control panel. All that is necessary is to remove the knob 3 and the frame 6 of a switch S and to thereupon insert and fixedly mount the housing 1 in the wall or plate of the control panel in a manner as described above.

Another advantage of the just described construction and mode of installing of the improved switch S is that one can readily replace the frame 6 and/or the knob 3 with a differently configurated, colored or dimensioned frame and/or knob without replacing the housing 1, the plunger 2 and/or other parts of the switch. For example, if the purchaser of the switch S desires to replace the knob 3 with a knob of a different shape and/or color, the person in charge simply detaches the frame 6 from the housing 1 upon rotation of the nut 12 in a direction to expose the grooves 9, whereupon the knob 3 is readily separable from the plunger 2 by the simple expedient of expelling the projections of arms 4 from the apertures of the arms 5. Replacement of the frame 6 with a differently configurated and/or colored frame is equally simple. The use of differently colored and/or configurated knobs 3 and/or frames 6 might be desirable or necessary in order to facilitate ready identification of a selected switch S when such switch constitutes one of a battery or array of several switches in a control panel. Moreover, the purchaser of the switch S might decide to replace the knob 3 and/or the frame 6 for other reasons, e.g., to enhance the appearance of the switch or of the control panel, or to replace a chipped or otherwise damaged or defaced knob 3 and/or frame 6 with an intact component. Thus, the manufacturer can store a large supply of housings 1, plungers 2 and nuts 12 because such parts need not be replaced when it becomes desirable or necessary to replace one or more knobs 3 and/or frames 6. The manufacturer further accumulates a requisite supply of differently colored and/or configurated frames 6 and/or knobs 3 so that he can immediately complete an order regardless of the desired size and/or shape of components 3 and/or 6.

The utilization of polygonal (e.g., rectangular) frames 6 is desirable and advantageous because several frames can be placed side-by-side or end-to-end without any or with minimal clearances therebetween, i.e., the exposed area of the wall on which the switches S are mounted is used more economically than with switches having circular frames. The equidistant arrangement of tongues 7 and grooves 9 is also desirable and advantageous because the person in charge can mount a frame 6 on the associated housing 1 in such a way that a rectangular frame may extend longitudinally or transversely of the control panel. Moreover, the just described distribution of tongues 7 and grooves 9 is especially desirable when several switches S are mounted on the same wall of a control panel or the like and the housing 1 of such switches cannot be rotated to change the angular positions of frames 6 and knobs 3 as a result of angular displacement of the respective housings 1. Such angular displacement of the housings 1 is prevented by parts 21 and 22 which will be described below.

The plunger 2 has a heart-shaped guide groove 13 whose open side faces the inner side of the housing 1. The adjacent portion of the housing 1 has an opening or cutout 14 whose slit-shaped inner portion is located in a plane normal or substantially normal to the axis of the plunger 2. The width of the opening 14 increases in a direction radially outwardly away from the axis of the plunger 2, i.e., a part which would fill the opening 14 would resemble an arcuate wedge. The outer end of the opening 14 has a circular shape and its inner end is a relatively narrow slit. This opening swingably receives the outer portion of a radially extending pin 15 which constitutes a follower for the plunger 2 in that its inner end portion extends into the heart-shaped groove 13. The outer end of the pin 15 extends beyond the opening 14 of the housing 1 and is engaged by a holding device 17 including a leaf spring 16 so that the inner end portion of the pin remains in the groove 13. The leaf spring 16 forms an integral part of or is attached to the holding device 17 which is an arcuate yoke whose suitably configurated (e.g., tooth-shaped) end portions constitute projections received in complementary recesses 18 of the housing 1 by snap action.

When the knob 3 is depressed to move the plunger 2 from the free position toward the operating position, the guide groove 13 allows the plunger 2 to assume the so-called overtravel position. When the pressure upon the knob 3 is relaxed, the spring 102 for the plunger 2 pushes the latter outwardly whereby the pin 15 enters the portion 13' of the guide groove 13 and maintains the knob 3 and the plunger 2 in the so-called release position. The arrangement is preferably such that the contacts which are closed in operating position of the plunger 2 are also closed in the release position. When the knob 3 is depressed again to move the plunger 2 from the release position to the overtravel position, the follower pin 15 again tracks the surfaces bounding the groove 13 and permits the plunger to return to the free position as soon as the pressure upon the knob 3 is relaxed or terminated.

Thus, the illustrated switch S is a latching switch, i.e., a switch of the type which can remain in the operating position (actually in the equivalent release position) in response to first depression of the knob 3, and which thereupon returns to the free position in response to renewed depression of the knob 3. This switch can be readily converted into a momentary switch (i.e., a switch of the type wherein the plunger 2 automatically returns to the free position in response to each depression of the knob 3 and following a termination or requisite relaxation of pressure upon the outer side of the knob). Such conversion is carried out as follows: The holding device or yoke 17 is detached from the housing 1 by expelling or withdrawing its projections or teeth from the recesses 18 so that the leaf spring 16 allows the pin 15 to move radially outwardly, e.g., be extracting the pin 15 with the prongs of a tweezer or the like. Alternatively, the control panel or the switch S (prior to mounting in the control panel) can be tilted to a position in which the pin 15 leaves the guide groove 13 and opening 14 by gravity as soon as the leaf spring 16 is detached from the housing 1. As mentioned above, the plunger 2 automatically returns to and remains in the free position as soon as the pressure upon the knob 3 is terminated or sufficiently relaxed, provided that the follower pin 15 is withdrawn from the guide groove 13. Alternatively, the switch S can be readily converted from a momentary switch (the plunger 2 returns to free position after each depression of the knob 3) into a latching switch wherein the plunger 2 returns to free position after each second actuation of the knob 3; all that is necessary is to reinsert the follower pin 15 and to secure it in the operative position by renewed attachment of the leaf spring 16 to the housing 1 via yoke 17. Such conversion of the switch S can be carried out without any tools or by resorting to rudimentary tools. The provision of removable follower pin 15 represents an additional saving to the manufacturer because it enables the manufacturer or the user to convert the switch S into a momentary switch (each depression of the knob 3 is followed by return movement of the plunger 2 to free position), into a more sophisticated latching switch wherein each second depression of the knob 3 precedes a return movement of the plunger 2 to the free position, or vice versa. Thus, the manufacturer need not maintain supplies of both types of switches.

That (inner) end portion of the housing 1 which is remote from the frame 6 is formed with a centrally located transverse channel 19 which is flanked by two lateral transverse channels 20 (see particularly FIG. 3). The centrally located channel 19 serves for reception of a tubular receptacle or support 21 (shown in FIG. 1) for blocking members 49 (FIG. 5) which prevent simultaneous depression of the knobs 3 of two or more switches of a battery of mechanical switches S on a control panel or the like. The receptacle 21 is common to two or more aligned housings 1. The lateral channels 20 can receive control rails 22 which serve a useful purpose when the illustrated switch S constitutes of one of an entire battery of switches (including one or more latching switches) on a control panel or the like. It is equally within the purview of the invention to provide the housing 1 solely with the channel 19 or solely with one or more channels 20. The open undersides of the channels 19 and 20 face the respective microswitches.

The housing 1 further contains a light source 101 (shown schematically in FIG. 2) which is received in a suitable lamp socket 101A and serves to illuminate the knob 3. The terminals of the socket 101A for the light source 101 are electrically connected with two electric contacts 23 which extend beyond the inner end portion of the housing 1 (see particularly FIG. 3).

The plunger 2 comprises a centrally located motion transmitting post 24 and two lateral motion transmitting posts 25 which flank the post 24. When the knob 3 is depressed, the posts 24, 25 move from the solid-line to the phantom-line positions of FIG. 3.

The group or block 30 of microswitches 27–29 is separably coupled to the inner end portion of the housing 1 by a connector 26 (hereinafter called adapter). It will be readily appreciated that microswitches constitute but one form of switching elements which can be actuated in response to depression of the plunger 2 through the medium of the knob 3. Furthermore, it is equally within the purview of the invention to assemble the block 30 of one or more microswitches and one or more other switching elements. Still further, the block 30 may consist of a larger number of switching elements.

The adapter 26 comprises two suitably bent elastic arms 31 having apertures 32 (see particularly FIG. 2). The apertures 32 can receive protuberances 33 provided at the outer side of the inner end portion of the housing 1 to thus insure that the adapter 26 is fixedly but separably coupled to the housing 1. The parts 31 and 33 together constitute a simple separable coupling between the housing 1 and the adapter 26.

That end portion of the adapter 26 which is remote from the housing 1 and from the elastic arms 31 carries three pairs of aligned elastic tongues 34. The tongues 34 of each pair flank and releasably hold one of the microswitches 27, 28, 29. Those side faces of the microswitches 27–29 which are adjacent to the respective tongues 34 have wedge-like or tooth-shaped projections 35 which snap into the openings 36 of the respective tongues 34 to thereby establish a fixed but separable connection or coupling between each microswitch and the adapter 26. The openings 36 and the projections 35 can be said to constitute a simple detent means for separably holding the microswitches between the tongues 34 of the respective pairs of tongues 34. All that is necessary to attach a microswitch to the adapter 26 is to push the microswitch upwardly (as viewed in FIG. 1, 2 or 3) into the space between the selected pair of tongues 34 until the projections 35 enter the corresponding openings 36. In order to remove a properly installed microswitch, the tongues 34 of the respective pair are spread apart so as to move their openings 36 outwardly of the respective projections 35 whereupon the thus released microswitch can be readily withdrawn or descends by gravity.

If the adapter 26 is to carry a single microswitch, the spaces normally occupied by the other two microswitches are preferably filled by resorting to dummies or blanks (not shown) whose configuration resembles that of the microswitch 27, 28 or 29.

It will be noted that the contacts 37 of all three microswitches 27–29 are located in a common plane, namely, in a plane which is normal to the axis of the plunger 2 (see particularly FIG. 3). Therefore, such contacts are readily accessible at the inner side of that wall or plate of the control panel which supports the switch S. Moreover, all microswitches 27–29 are accessible at the inner side of the aforementioned plate or wall so that they can be interchanged, replaced or removed while the housing 1 remains attached to the wall and while the adapter 26 remains connected to the housing 1. Thus, the number and distribution of microswitches can be altered at will while the remaining components of the switch S remain secured to the control panel. For example, if a microswitch is defective, it can be replaced while the other two microswitches remain coupled to the adapter 26.

The microswitches 27–29 include depressible moving portions or studs 38 which are located in the path of inward movement of the motion transmitting posts 24 and 25 at the inner end of the plunger 2. Thus, all three microswitches 27–29 are actuated in response to each depression of the plunger 2 to the operating position.

Those side faces of the microswitches 27–29 which are not provided with projections 35 for the respective tongues 34 have longitudinally extending grooves 39. Each groove 39 of the centrally located microswitch 28 defines with the adjacent groove 39 of the neighboring microswitch 27, 29 an elongated passage of substantially rectangular cross-sectional outline. Such passages receive portions of two contacts 40 which connect the terminals of the lamp socket 101A with a suitable source of electrical energy. The outer portions of the contacts 40 are disposed in the common plane of the microswitch contacts 37, which is desirable and advantageous because the contacts 40 can be readily connected with conductors upon attachment of housing 1 to the wall of a control panel or the like. The inner portion of each contact 40 constitutes a substantially U-shaped elastic body 41 consisting of conductive material and serving to receive one of the contacts 23. Thus, when the contacts 40 are connected to the poles of an energy source (not shown), the lamp 101 in the socket 101A in the housing 1 emits light to illuminate the knob 3.

When the adapter 26 is advanced toward the inner end portion of the housing 1 to move the apertures 32 toward the respective protuberances 33, the contacts 23 slide in the respective passages (defined by the grooves 39 of the centrally located microswitch 28 and the adjacent grooves 39 of the microswitches 27, 29) and ultimately engage and enter between the flanges of the inner portions 41 of the respective contacts 40. The manner in which a contact 23 engages the corresponding inner portion 41 is shown in the lower half of FIG. 2 by broken lines. The contacts 40 can be permanently or removably installed in the grooves 39 of the centrally located microswitch 28. The conductors which connect the contacts 40 with the poles of an energy source can be attached to the contacts 40 simultaneously with attachment of conductors to the contacts 37 of the microswitches 27–29. As a rule, the conductors for the contacts 40 will be grouped together and separately from the conductors which are connected to the contacts 37.

Figure 6:
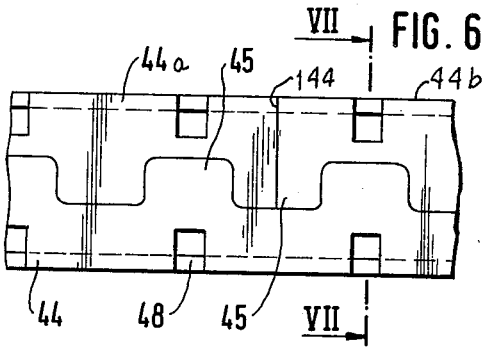
FIG. 6 is a fragmentary elevational view of the assembled receptacle.
Figure 4:
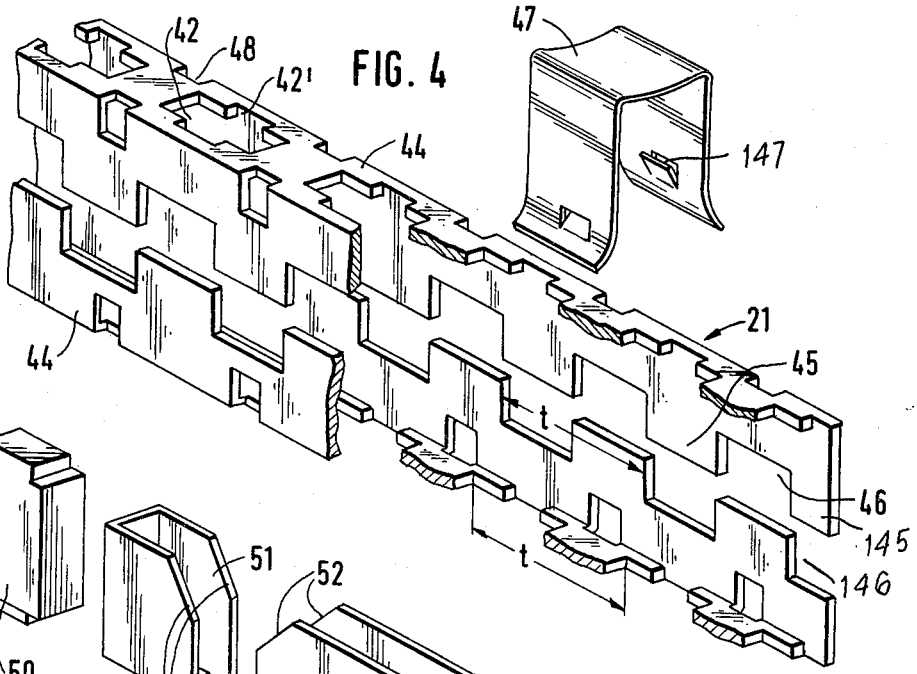
FIG. 4 is a fragmentary exploded perspective view of a tubular receptacle for blocking and other members which cooperate to prevent simultaneous actuation of two switches of the type shown in FIG. 1.

The switch S of FIGS. 1 to 3 is assumed to form part of a battery of such switches which further include a tubular receptacle or support 21 for blocking members 49 or analogous means for preventing simultaneous depression of several knobs 3. The battery may include momentary switches S wherein the plunger 2 returns to free position after each depression of the respective knob 3 and/or one or more latching switches wherein the plunger 2 reassumes or is free to reassume the free position after each second depression of the respective knob 3. The details of a suitable tubular receptacle 21 are shown in FIGS. 4, 6 and 7. The top and bottom walls (as viewed in FIGS. 1 and 4) of the receptacle 21 are formed with registering cruciform openings 42 which are equally spaced from each other, as considered in the longitudinal direction of the receptacle. Each opening 42 is or can be located in the housing 1 of a discrete switch S, namely, in the channel 19 of the respective housing 1. Each housing 1 has two centering projections 43 (one indicated in FIG. 1) which extend into portions of the adjacent opening 42 and maintain the latter in exact register with the central motion transmitting post 24. The (lower) opening 42 which is aligned with the opening 42 for the centering projections 43 receives the movable portion 38 of the centrally located microswitch 28, i.e., such movable portion is in the path of inward movement of the post 24. At the same time, the movable portions 38 of the outer microswitches 27, 29 are located in the path of movement of the corresponding lateral posts 25.

If the switches S which are coupled to each other by a common tubular receptacle 21 are latching switches, such mode of operation can be insured by resorting to the aforediscussed follower pins 15, one for each switch S, or by resorting to a modified device including one of the aforementioned control rails 22. The pins 15 are removed if the switches S are to operate as momentary switches.

The tubular receptacle 21 of FIGS. 1, 4, 6 and 7 comprises at least two complementary U-shaped sections 44 which are preferably of identical size and shape and have identical lengths. The flanges of the sections 44 are toothed, i.e., they are provided with teeth 45 which alternate with tooth spaces 46. When two sections 44 of the type shown in FIG. 4 are assembled to form a receptacle 21, the teeth 45 of one section extend into the tooth spaces 46 of the other section and vice versa. The resulting receptacle 21 is a tube having a rectangular cross-sectional outline. If a relatively short receptacle 21 suffices, such receptacle can be assembled of two sections 44 having standard lengths. The sections 44 are held together by U-shaped elastic clamps 47 one of which is shown in FIG. 4. The clamps 47 hold the assembled sections 44 against lateral and/or longitudinal shifting relative to each other. Longitudinal shifting of sections 44 relative to each other is further prevented by the teeth 45. The clamps 47 have inwardly extending lugs 147 which can snap into complementary cutouts 48 provided in both edge portions of each section 44, i.e., in those portions where the toothed flanges merge into the web of the respective section. The cutouts 48 form four rows and the cutouts of each row are equally spaced from each other. As shown in FIG. 4, the cutouts 48 also form groups of four cutouts each, and such groups alternate with pairs of registering openings 42. The major portions of or the entire cutouts 48 are provided in the flanges of the respective sections 44; this insures that the webs of the sections 44 are not unduly weakened and, consequently, the openings 42 can be placed rather close to each other. The provision of a relatively large number of closely adjacent openings 42 in the web of each section 44 is desirable and advantageous because this allows for mounting of neighboring switches S close to or at a greater distance from each other. For example, if the distance t between the centers of neighboring openings 42 is 6 millimeters, the distance between the axes of plungers of neighboring switches S may be 12, 18, 24, 30, 36, 42, etc. mm. In other words, the distance between the axes of neighboring plungers may be a whole multiple of 6 mm. The spacing of 6 mm is only an example, i.e., the distance between the centers of neighboring openings 42 may be larger or smaller, and the spacing between neighboring switches S of a row of such switches need not be identical. In each instance, the cutouts 48 are preferably provided in the flanges of the sections 44 to thus insure that the assembled receptacle 21 exhibits satisfactory resistance to flexing and/or other deformation.

If the desired length of a receptacle 21 exceeds the standard length of a section 44, the receptacle is assembled of three or more sections 44 whereby the sections of one row are staggered with respect to the sections of the other row. For example, and referring to FIG. 6, the upper section may be a composite section consisting of two or more aligned sections **44*a*, 44*b*, etc. of standard length and such sections then abut against each other in a plane including the vertical line 144. The lower section 44 is staggered with respect to the sections 44***a* and 44*b*, i.e., its teeth 45 extend into the tooth spaces of both upper sections. The arrangement must be such that each opening 42 of a composite section registers with an opening 42 of the other section 44. In the embodiment which is shown in FIG. 4, the distance t between the centers of two neighboring openings 42 equals the combined width of a tooth 45 and a tooth space 46, as considered in the longitudinal direction of the receptacle 21. This insures that an upper opening 42 invariably registers with a lower opening 42 regardless of the manner in which the sections 44 are staggered with respect to each other. However, the distance t can be altered without departing from the spirit of the invention; for example, the combined width of a tooth 45 and a tooth space 46 need not equal the distance between the centers of openings 42. The combined width of two neighboring a tooth 45 and a tooth space 46 should equal n times the distance between the centers of two neighboring openings 42 in a section 44 (n is a whole number including one). All that is desirable is to insure that each opening 42 in the upper section 44 (regardless of whether such section is a one-piece body or a composite structure consisting of several sections 44*a*, 44*b*, etc. of standard length) registers with an opening 42 of the associated lower section 44 (this lower section, too, may consist of a single section of standard length or of two or more aligned sections of standard length).

Figure 8:
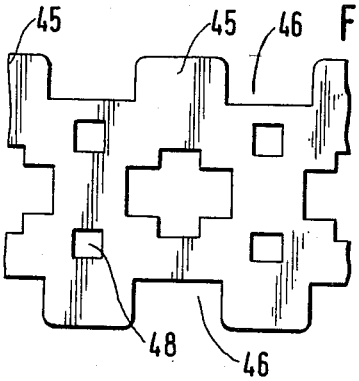
FIG. 8 is a developed view of one U-shaped section of the receptacle which is shown in FIGS. 4 and 6.

A very simple and inexpensive mode of making the sections 44 includes resort to a sheet metal blank which is treated in a punching press to assume the shape shown in FIG. 8. The blank is thereupon converted into a U-shaped section by bending its upper and lower marginal portions into two parallel planes located at right angles to the central portion. Such mode of making the sections 44 insures a high degree of accuracy and reproducibility; moreover, the manufacturing cost is low because the sections 44 can be punched and shaped by resorting to available machinery. FIG. 8 further shows that each tooth space 46 in one marginal portion of the blank registers with a tooth 45 in the other marginal portion, and vice versa.

FIG. 4 shows that one end portion of each flange of a section 44 has a tooth 145 whose width is half the width of teeth 45, and that the other end portion of such flange has a tooth space 146 whose width is half the width of tooth spaces 46.

Figure 5:
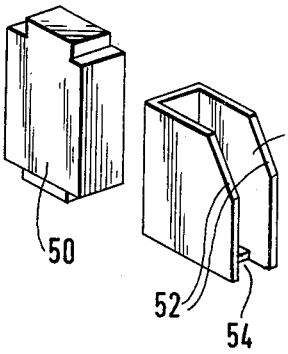
FIG. 5 is a perspective view of blocking and other members which are confined in the receptacle of FIG. 4.
Figure 5:
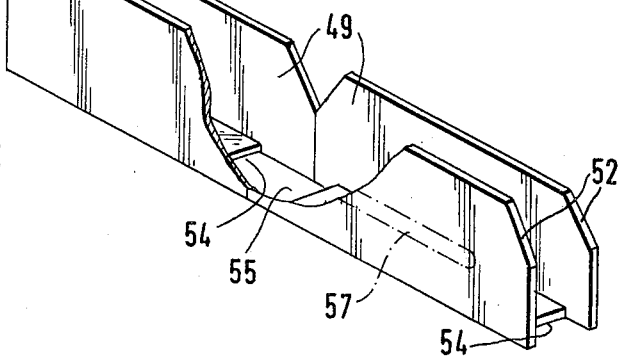

The tubular receptacle 21 accommodates longitudinally movable blocking members or blockers 49 which serve to prevent simultaneous depression of two or more knobs 3 in a battery of two or more aligned switches S. The end portions of the receptacle 21 receive suitably configurated stop members 50 one of which is shown in FIG. 5. Each stop member 50 is adjacent to an intermediate member 51 which is inserted into the receptacle 21 between such stop member 50 and the nearest blocking member 49. The neighboring end faces of blocking members 49 and intermediate members 51 are facetted, as at 52, so that they define substantially V-shaped notches which receive the wedge-like inner end portion of a centrally located post 24 while such post extends through the aligned opening 42 of the upper section 44 of the receptacle 21. The post 24 has lateral projections or ribs 53 which can engage the blocking members 49 in the receptacle 21. Such ribs slide along the facets 52 while the post 24 moves downwardly whereby the thus engaged blocking members 49 move lengthwise of the receptacle 21. The extent of displacement of the blocking members 49 is such that the outermost blocking members 49 abut against the respective intermediate members 51 and the latter bear against the neighboring stop members 50. If the post 24 descends between a blocking member 49 and the adjacent intermediate member 51, it moves such members 49, 51 apart until the member 51 abuts against the adjacent stop member 50 and the remotest member 49 urges the other intermediate member 51 against the respective stop member 50.

Figure 12:
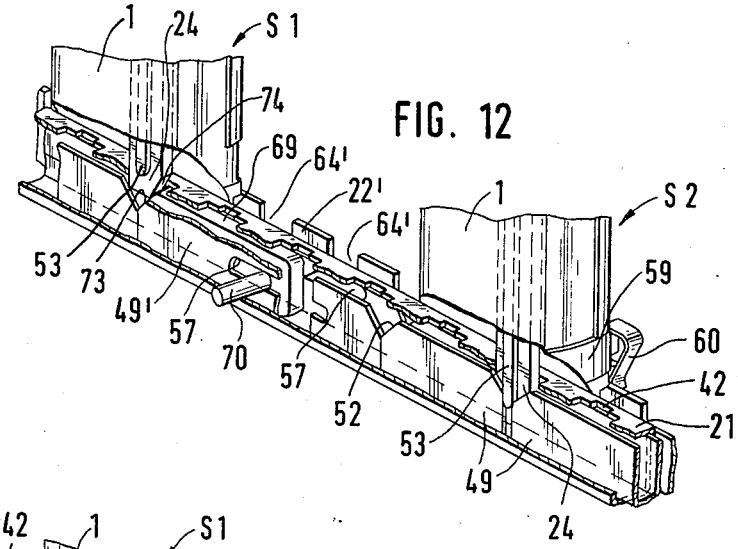
FIG. 12 is a perspective view of a second multiple-switch arrangement including a battery of several switches one of which constitutes a releasing means for the other switch or switches.
Figure 13:
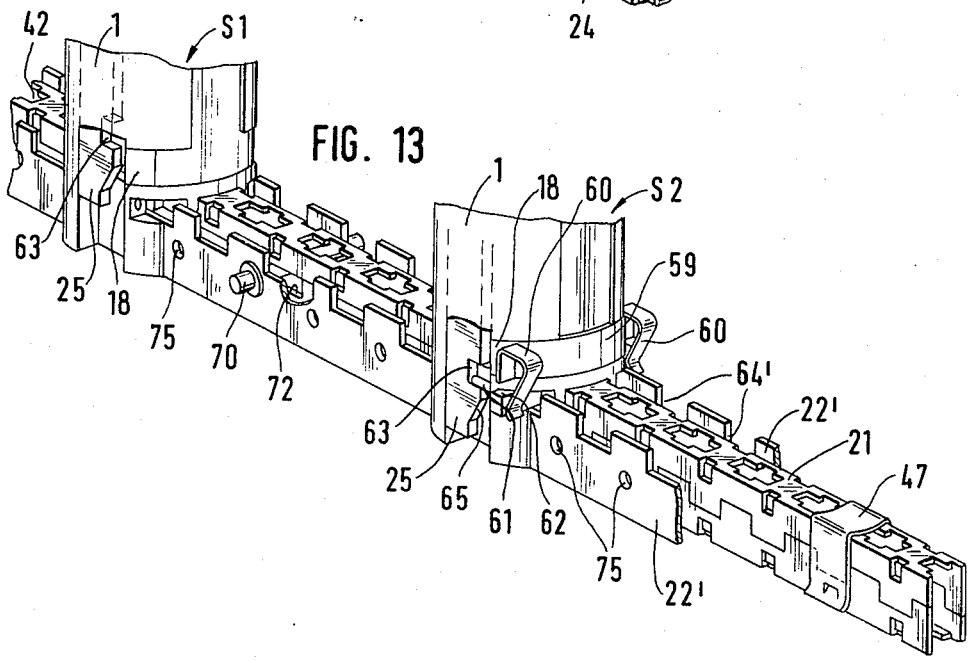
FIG. 13 is a similar perspective view of the structure shown in FIG. 12, further showing the second control rail of the means for directly releasing a depressed switch in response to actuation of the left-hand switch.

Each blocking member 49 may consist of sheet metal and resembles a U-shaped body. Alternatively, each such blocking member can be assembled of two plate-like constituents which are held in spaced parallel planes by suitable distancing elements. The facets 52 of the blocking members 49 are normally in line with the portions 42' of the adjacent openings 42, i.e., with those portions of the openings 42 which permit entry of the ribs 53 into the receptacle 21. FIG. 5 shows that the webs of the U-shaped blocking members 49 and of the intermediate member 51 are formed with cutouts 54 so that the cutouts 54 of neighboring blocking members 49, 51 define rectangular openings 55. This enables the suitably configurated tip of the centrally located post 24 to penetrate through the webs of the adjacent blocking members 49 and to actuate a control member 69 which is shown in FIG. 12. The just mentioned tip of the post 24 extends beyond the respective ribs 53. The control member 69 is reciprocable in one of the blocking members 49. As shown in FIGS. 12 and 13, the control member 69 has a laterally extending stud 70 which is reciprocable in a lateral slot 57 of the respective blocking member 49 and can displace a control rail 22. The members 49, 50 and 51 can be inserted into one section 44 of the tubular receptacle 21 before the one section is assembled with the other section 44. As mentioned above, the receptacle 21 can be assembled of two or more discrete sections 44 of unit or standard length, depending on the desired overall length of the receptacle.

It is also possible to assemble the receptacle of two substantially L-shaped profiled sections. The teeth and tooth spaces of such sections are distributed in the same way as or in a manner similar to that of the teeth 45 and tooth spaces 46. One half of each L-shaped section is provided with a row of openings corresponding to the openings 42 of U-shaped sections 44.

FIGS. 9 and 10 show a multiple-switch arrangement in the form of a battery of discrete mechanical switches including the switches S1 and S2. The yoke 17 of FIG. 1 is replaced with modified holding means or yokes 59 whose teeth or analogous projections extend into the recesses 18 of the respective housings 1. The end portions of each yoke 59 carry or constitute elastically deformable lamellae 60 which bear against reciprocable pins 61 mounted in the corresponding housing 1. The pins 61 have enlarged heads 62 which are engaged and biased by the adjacent lamellae 60. The lateral posts 25 of the plungers in the housings 1 of the switches S1 and S2 have notches 63 which receive portions of the respective pins 61 (under the bias of the associated lamellae 60) in response to depression of the corresponding knobs 3. The manner in which the pins 61 extend into the notches 63 of the corresponding posts 25 is shown for the switch S2 of FIG. 10. When the knob 3 is depressed, the pins 61 slide along inclined cam faces 65 of the respective posts 25 to be shifted against the opposition of the respective lamellae 60 until the posts 25 descend to the level at which the pins 61 are free to enter the adjacent notches 63. The parts 59–63 constitute detent means for releasably holding the respective motion transmitting posts 25 in the depressed or second positions, i.e., in those positions in which the posts 25 depress the movable portions 38 of the corresponding microswitches 27, 29. At the same time, the post 24 depresses the movable portion 38 of the corresponding microswitch 28.

One marginal portion of each control rail 22 is formed with a row of recesses 64 which are equidistant from each other. The spacing t between the centers of neighboring recesses 64 is preferably the same as that between the centers of neighboring openings 42 in the sections 44 of the tubular receptacle 21. The width of each recess 64 is such that the latter can receive, practically without any play, the head 62 of a pin 61. For example, when the knob 3 of the switch S1 is depressed to move the respective plunger from the free position, the posts 24 and 25 move downwardly, as viewed in FIGS. 10 and 11, whereby the cam faces 65 at the tips of the posts 25 displace the respective pins 61 against the opposition of the associated lamellae 60. The heads 62 of the thus displaced pins 61 move the control rails 22 lengthwise in the directions indicated by arrow A shown in FIG. 11. This results in displacement of pins 61 in the housing 1 of the switch S2 because the control rails 22 receive the heads 62 of pins 61 of both switches. Consequently, the pins 61 of the switch S1 are withdrawn from the notches 63 of the respective posts 25 so that the plunger of the switch S1 can return to the free position (provided, of course, that the plunger of the switch S1 was held in the operating position prior to depression of the knob forming part of the switch S2). The mode of operation is repeated in reverse when the knob of the switch S1 is depressed to move the corresponding posts 24 and 25 downwardly, as viewed in FIGS. 10 and 11, i.e., the heads 62 of pins 61 which are reciprocable in the housing 1 of the switch S1 shift the control rails 22 so that the rails 22 displace the pins 61 of the switch S2 to the extent which is necessary to permit return movement of the plunger of the switch S2 to the free position. In other words, the rails 22 replace the follower pin 15 of FIG. 1 and further insure that only one of the knobs 3 remains in depressed position.

The lamellae 60 of the switches S1 and S2 bias the control rails 22 in a direction counter to that indicated by the arrow A. If desired, the bias of the lamellae 60 can be supplemented by one or more discrete springs; in fact, such discrete spring or springs can be used as a substitute for the lamellae 60.

The control rails 22 consist of several units or sections whose end portions are articulately and separably coupled to each other by tongues 66 and undercut grooves 67 (see FIG. 11). One end of each unit or section of a rail 22 has a groove 67 and the other end of the same unit has a tongue 66. When a tongue 66 enters the groove 67 of the adjacent unit, the two units can be held against accidental separation by a suitable clip 68 shown in FIG. 11. Each control rail 22 can be assembled of two or more units, depending on the number of switches S in the row of switches which are mounted on a common tubular receptacle 21.

The control rails 22 insure that the knob 3 of one of the switches including the switches S1 and S2 of FIGS. 9 and 10 automatically returns to the free position when the knob of another switch is depressed. The aforementioned blocking members 49 in the tubular receptacle 21 prevent simultaneous depression of two or more knobs 3. As explained above, the intermediate members 51 and the stop members 50 limit the extent of lengthwise movement of blocking members 49 in the receptacle 21. The combined clearance between all blocking members 49, the two intermediate members 51 and the stop members 50 is selected in such a way that it equals or approximates the width of a rib 53. This automatically insures that only one of the plungers can be depressed at a time; the ribs 53 of the depressed post 24 then penetrate between the neighboring blocking members 49 subsequent to sliding along the respective facets 52 and maintain the parts 49, 50 and 51 in the receptacle 49 against any or against appreciable lengthwise movement with respect to the sections 44, i.e., there is no room for penetration of another pair of ribs 53 between the neighboring blocking members 49 or between a blocking member and the adjacent intermediate member 51.

It will be noted that the receptacle 21 and the control rails 22 extend substantially transversely of the housings 1 between the inner end portions of such housings and the respective blocks of microswitches.

FIGS. 12 and 13 show a portion of a second multiple-switch arrangement having a battery of switches including the switches S1 and S2. The switch S1 is a momentary switch and constitutes a means for releasing all other switches. The sole differences between the switch S1 and the switch S2 (as well as other switches, not shown, which are identical with the switch S2) are as follows: The switch S1 does not include the yoke 59 and lamallae 60 (more accurately stated, the parts 59 and 60 are removed). The pins 61 (with their heads 62) are removed, too, i.e., the posts 24, 25 of the switch S1 serve the sole purpose of actuating the microswitches. The heads 62 of pins 61 in the switch S2 (and all other switches which are identical with the switch S2) extend into the adjacent recesses 64' of the respective control rails 22'. The recesses 64' of the rails 22' are wider than the recesses 64 of the control rails 22 shown in FIGS. 9–11. The difference between the width of a recess 64 and the width of a recess 64' equals the stroke of a pin 61, namely that distance which a pin 61 covers while moving along the cam face 65 of a post 25 (against the opposition of the respective elastic lamella 60) or while moving into a notch 63 under the bias of the adjacent lamella. Consequently, depression of the knob in a switch S2 cannot result in longitudinal displacement of the control rails 22', i.e., these rails cannot disengage the pins 61 of other switches from the respective posts 25 when the knob of the switch S2 is depressed. Instead, the control rails 22' can be moved lengthwise by the aforementioned control member 69 which is installed in the blocking member 49' adjacent to the switch S1. The aforementioned stud 70 of the control member 69 has end portions which extend outwardly through the slots 57 of the blocking member 49' and through registering slots 72 of the tubular receptacle 21. The slots 72 of the receptacle 21 are obtained by removing two transversely aligned teeth 45.

The control member 69 has a cam face 73 which cooperates with a complementary cam face 74 at the forward end of the centrally located post 24. When the knob of the switch S1 is depressed, the post 24 moves toward the receptacle 21 whereby the cam face 74 engages and slides along the cam face 73 to thereby shift the control member 69 in a direction to the right, as viewed in FIG. 12. The stud 70 shares the movement of the control member 69 and slides in the respective slots 57 and 72. The outermost portions of the stud 70 are received in holes or bores 75 of the respective control rails 22'. Thus, the rails 22' share the movements of the control member 69 and shift the heads 62 of pins 61 of all actuated switches S2 relative to the corresponding notches 63 so that the plungers and knobs of such switches S2 can reassume their free positions. The stud 70 constitutes a simple means for coupling the control member 69 to the rails 22'.

The switch S1 of FIGS. 12 and 13 can be readily converted into a latching switch by the simple expedient of inserting a follower pin 15 and holding such pin in position by the leaf spring 16 of a yoke 17 which is attached to the housing 1 of the switch S1 in the same way as described in connection with FIG. 1.

Figure 14:
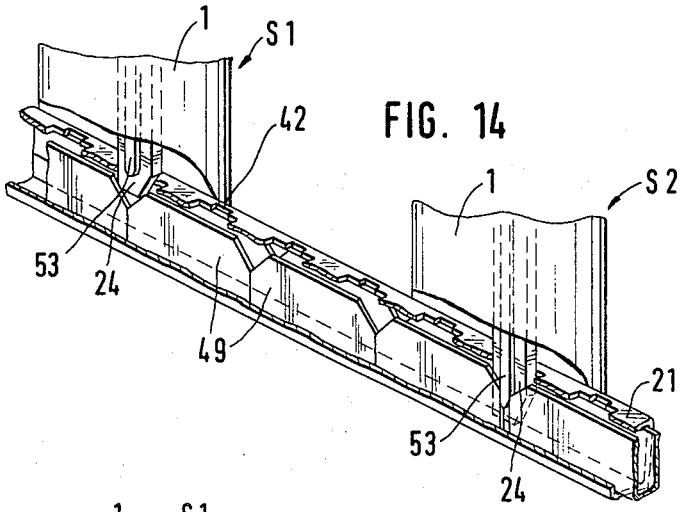
FIG. 14 is a perspective view of a third multiple-switch arrangement including a battery of several aligned switches.
Figure 15:
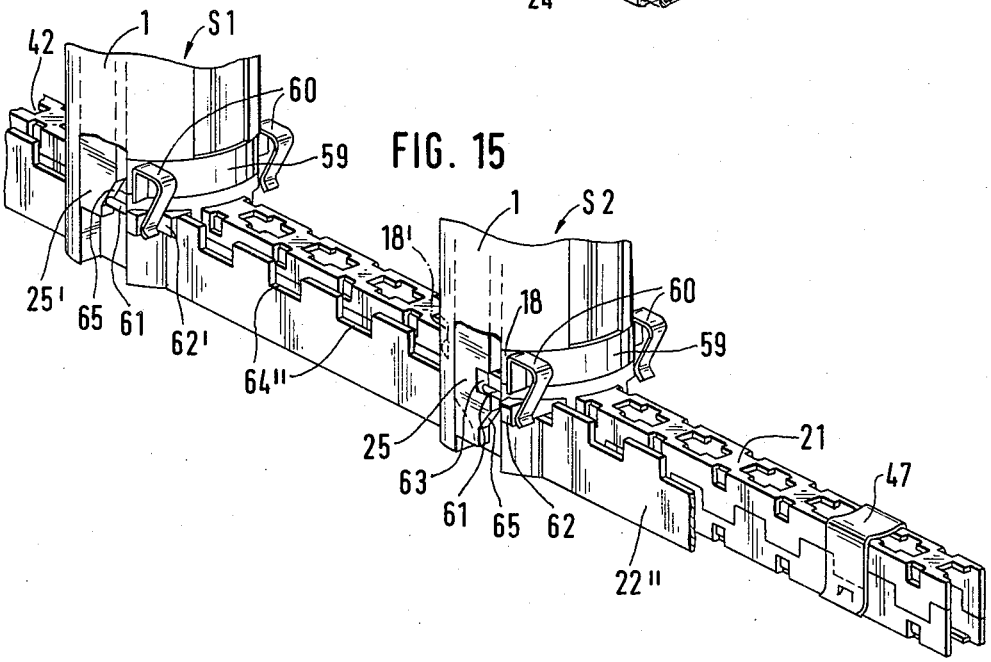
FIG. 15 is a similar perspective view of the structure shown in FIG. 14, further showing certain modifications of the right-hand switch.

The multiple-switch arrangement of FIGS. 14 and 15 comprises a battery of switches including the switches S1 and S2. The switch S1 constitutes a releasing means because one of its lateral posts 25' can shift a single control rail 22''. The switch S2 and all other switches S2 (not shown) are latching switches. The control member 69 and its coupling stud 70 are replaced by a modified control system which can shift the single control rail 22'' in response to depression of the knob at the outer end of the housing 1 of the switch S1. The lateral posts 25' of the switch S1 are devoid of notches 63 and the width of recesses 64'' in the control rail 22'' is the same as described in connection with the recesses 64' of FIGS. 12 and 13. Thus, the heads 62 of pins 61 which are mounted in the housings 1 of the switches S2 can move in the respective recesses 64'' without causing any longitudinal displacement of the control rail 22''. When the knob of a switch S2 is depressed, the head 62 of the corresponding pin 61 lies against one (front or rear) surface bounding the respective recess 64''.

The head 62' of the pin 61 in the switch S1 is somewhat different, namely, its dimensions are such that it completely fills the adjacent recess 64'' of the control rail 22''. In other words, the control rail 22'' must share all axial movements of the head 62'. The head 62' is biased by one lamella 60 of the yoke 59 on the housing 1 of the switch S1 so that the pin 61 which includes the head 62' normally assumes its inner end position. When the knob of the switch S1 is depressed, the post 25' moves downwardly, as viewed in FIG. 14 or 15, whereby its cam face 65 causes the pin 61 and the head 62' of such pin to move to the other end position. This suffices to shift the control rail 22'' whereby the latter enables the plunger of the actuated switch S2 to reassume its free position.

The manufacturing cost of the arrangement which is shown in FIGS. 14 and 15 is somewhat higher than the cost of the arrangement of FIGS. 12–13 because the switch S1 of FIGS. 14–15 must be provided with a post 25' which is not formed with a notch 63. The making of such non-standard post 25' can be avoided by converting the switch S2 of FIGS. 14 and 15 into a momentary switch in the following way: The housing 1 of the switch S2 is provided with a second pair of recesses 18' (one indicated in FIG. 15 by broken lines) opposite and mirror symmetrically with respect to the recesses 18. Also, one post 25 of the switch S2 is formed with a second cam face located opposite and mirror symmetrical to the cam face 65. Still further, the housing 1 of the switch S2 must be provided with a hole for a second reciprocable pin 61 having a head 62. Such second pin 61 is biased by one lamella 60 of a yoke 59 which has teeth extending into the recesses 18'. The thus modified switch S2 is mounted on the receptacle 21 in inverted position (turned around by 180 degrees) and serves as a releasing means, the same as the switch S1 of FIGS. 14–15.

The arrangement of FIGS. 14–15 may comprise two control rails 22'' and the housings 1 of the switches S1 and S2 then carry pairs of pins 61 with heads 62 (switches S2) and 62' (switch S1). Analogously, the arrangement of FIGS. 9–10 can operate properly with a single control rail 22 and the arrangement of FIGS. 12–13 can also employ a single control rail 22'.

The improved switches and arrangements of switches are susceptible of many additional modifications without departing from the spirit of the invention. For example, the reciprocable knobs 3 can be replaced with pivotable and/or rotary actuating elements for effecting axial movements of the respective plungers.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. In a mechanical switch, particularly in a latching or momentary switch, the combination of an elongated housing including a tubular front end portion having external threads and a plurality of external grooves extending lengthwise of said housing; a frame adjacent to said front end portion and having arms extending lengthwise of said housing and into said grooves; and a nut meshing with said end portion and movable on the latter frontwardly toward a mounting position in which it surrounds said arms and presses the same into said grooves to affix said frame to said housing, and rearwardly toward a releasing position in which said arms are exposed and said frame is separable from said housing.

2. The combination of claim 1, wherein said arms are elastic.

3. The combination of claim 1, wherein said end portion has four grooves spaced apart from each other by 90 degrees, as considered in the circumferential direction of said end portion.

4. The combination of claim 1, wherein at least one of said grooves includes a shallower first portion and a second portion of greater depth, that particular arm of said frame which extends into said one groove having a protuberance received in said portion of greater depth.

5. The combination of claim 4, wherein said particular arm is received in said one groove with a clearance which is less than the clearance necessary to permit withdrawal of said particular arm from said one groove while said arms are surrounded by said nut.

6. The combination of claim 1, wherein said housing includes a second end portion and further comprising an adapter, means for separably coupling said adapter to said second end portion, a plurality of discrete switching elements, and means for separably coupling said switching elements to said adapter.

7. The combination of claim 6, wherein said switching elements together constitute a block of closely adjacent aligned switching elements.

8. The combination of claim 6, wherein said switching elements include contacts extending therefrom in a direction away from said second end portion of said housing and disposed in a common plane making a right angle with the longitudinal direction of said housing.

9. The combination of claim 6, wherein said means for separably coupling said switching elements to said adapter comprises a pair of elastic tongues provided on said adapter for each of said discrete switching elements, the tongues of each pair flanking the respective switching element.

10. The combination of claim 9, wherein said switching elements and said tongues include cooperating detent means for separably holding the switching elements between the tongues of the respective pairs.

11. The combination of claim 10, wherein each of said detent means includes projections provided on said switching elements and openings provided in said tongues for reception of the respective projections.

12. The combination of claim 6, wherein said housing has at least one transverse channel adjacent to and having an open side facing said switching elements.

13. The combination of claim 12, further comprising a tubular receptacle extending through said channel and being movable transversely of said housing.

14. The combination of claim 12, further comprising a control rail extending through said channel and being movable transversely of said housing.

15. The combination of claim 1, wherein said housing further includes a second end portion and further comprising an actuating element movably mounted in said frame, means for illuminating said actuating element, said illuminating means including a lamp socket installed in the interior of said housing and means for connecting said socket with a source of electrical energy including a pair of electric contacts extending from said second end portion of said housing.

16. The combination of claim 15, further comprising a plurality of switching elements separably secured to said second end portion of said housing and having second contacts extending in a direction away from said second end portion, said connecting means further including third contacts having first portions disposed between said switching elements and conductively connected with said first mentioned contacts and second portions aligned with said second contacts.

17. The combination of claim 16, wherein said switching elements are adjacent to each other and the neighboring switching elements define passages which receive said first mentioned contacts and said first portions of said third contacts.

18. The combination of claim 1, wherein said housing has an opening including a slit-shaped inner portion and a second portion flaring outwardly toward the exterior of said housing, and further comprising a member movably received in said housing and having a guide groove inwardly adjacent said opening, a follower pin swingably received in said opening and having an inner portion extending into said guide groove, and means for holding said follower pin in said opening and said guide groove, said inner portion of said opening extending transversely of the direction of movement of said member.

19. The combination of claim 18, wherein said movable member is a plunger which is reciprocable in said housing and said follower pin further includes an outer portion extending outwardly beyond said opening, said holding means including a resilient element abutting against said outer portion of said follower pin.

20. The combination of claim 18, further comprising means for separably coupling said holding means to said housing.

21. The combination of claim 20, wherein said coupling means includes recesses in said housing and projections provided on said holding means and removably received in said recesses.

* * * * *